US008163452B2

(12) United States Patent
Imamura

(10) Patent No.: US 8,163,452 B2
(45) Date of Patent: Apr. 24, 2012

(54) DEVELOPING AGENT, IMAGE FORMING METHOD AND IMAGE FORMING APPARATUS

(75) Inventor: Yosuke Imamura, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 693 days.

(21) Appl. No.: 12/255,345

(22) Filed: Oct. 21, 2008

(65) Prior Publication Data

US 2009/0130584 A1 May 21, 2009

Related U.S. Application Data

(60) Provisional application No. 60/988,350, filed on Nov. 15, 2007.

(51) Int. Cl.
*G03G 9/00* (2006.01)

(52) U.S. Cl. ..... 430/108.6; 430/105; 430/108.1; 430/111.1

(58) Field of Classification Search ..... 430/105, 430/108.1, 108.6, 111.1
See application file for complete search history.

(56) References Cited

U.S. PATENT DOCUMENTS

2005/0271969 A1* 12/2005 Choi et al. ..... 430/137.1
2006/0240350 A1* 10/2006 Shu et al. ..... 430/108.6

* cited by examiner

*Primary Examiner* — Thorl Chea
(74) *Attorney, Agent, or Firm* — Turocy & Watson, LLP

(57) ABSTRACT

A developing agent includes a carrier; a toner in which an inorganic oxide external additive has a coverage of from 60 to 120% relative to a core toner; and a charging auxiliary particle having charge properties of a positive electrode and having a volume average particle size of from 5 to 15 μm in an addition amount of from 0.5 to 6% by weight relative to the developing agent.

14 Claims, 3 Drawing Sheets

FIG. 5

| | Toner particle size D50 (by volume) | Addition amount of external additive to core toner (% by weight) (coverage: %) | Addition amount of metal oxide to the total amount of developing agent (%) | Fog | Image failure due to staining within apparatus |
|---|---|---|---|---|---|
| Example 1 | 5 | 4.5 (90 %) | 2 | Good | Good |
| Example 2 | ↑ | 3 (60 %) | 4 | Good | Good |
| Example 3 | 10 | 2.5 (90 %) | 2 | Good | Good |
| Example 4 | 8 | 2 (60 %) | 4 | Good | Good |
| Example 5 | 7 | 3.5 (90 %) | 3 | Good | Good |
| Comparative Example 1 | 7 | 4.5 (120 %) | 4 | Poor | Good |
| Comparative Example 2 | ↑ | 1 (30 %) | 1 | Poor | Poor |
| Comparative Example 3 | 5 | 2.5 (50 %) | 1.5 | Poor | Poor |
| Comparative Example 4 | ↑ | 6 (120 %) | 4 | Poor | Poor |
| Comparative Example 5 | 10 | 3 (120 %) | 0.1 | Poor | Poor |
| Comparative Example 6 | 8 | 2 (60 %) | 6 | Poor | Good |

DEVELOPING AGENT, IMAGE FORMING METHOD AND IMAGE FORMING APPARATUS

CROSS-REFERENCE TO RELATED APPLICATION

This application is based upon and claims the benefit of priority from the prior U.S. Patent Application No. 60/988,350 filed on Nov. 15, 2007, the entire contents of which are incorporated herein by reference.

TECHNICAL FIELD

The present invention relates to a developing agent to be used in forming an image by an electrophotographic system, for example, copiers and printers, an image forming method and an image forming apparatus.

BACKGROUND

In general, in an image forming apparatus using an electrophotographic system, a toner is conveyed via a conveyance medium including an electrostatic latent image carrier such as a photoconductor and an intermediate transfer medium such as a transfer belt and deposited at a desired position on a transfer medium such as paper. The toner is then subjected to contact bonding by heat rollers or the like and fixed onto the transfer medium, thereby forming an image on the transfer medium.

In a two-component developing agent, a toner is mixed with a carrier which is a magnetic fine particle whose surface is coated with an epoxy resin, etc. and used. The carrier is stirred together with the toner in a developing machine, thereby charging the toner and depositing it onto a photoconductor, etc. due to an electrostatic effect.

In recent years, in an image forming apparatus which is free from a system for exchanging a developing agent, in order to reduce the exchange frequency, it is required to realize a long life of a developing agent. In realizing a long life of a developing agent, a problem to be caused due to a stirring stress between a toner and a carrier in a developing machine is visualized. As the problem to be caused due to a stirring stress, deterioration of a carrier due to peeling of a surface coating layer of the carrier and separation or burying of an inorganic oxide to be externally added in a toner matrix particle are exemplified.

As a method for suppressing peeling of a surface coating layer of a carrier, a method for thickening the surface coating layer is exemplified. In order to achieve thickening, it may be considered to perform a coating treatment by combining plural kinds of surface treating agents. However, there are involved problems such as an increase of costs, complication of treatment steps and heterogeneity of the surface coating layer. Furthermore, even by subjecting to a thickening treatment, the initial carrier surface resistance cannot be kept. By repeating a printing durability test, the surface coating layer is peeled away. This is because the surface resistance is lowered, thereby causing failures such as toner flying and fog.

As a method for suppressing the separation of an external additive of a toner, an enhancement of an adhesive force of an external additive to a core toner is exemplified. The adhesive force can be increased depending upon an external addition condition such as a time and a revolution number at the external addition. However, when the external additive is deposited strongly too much, the external additive is buried in the core toner, thereby affecting flow properties or charge properties.

As described previously, in order to suppressing the deterioration of a carrier or the separation of an external additive of a toner, various investigations have been made. However, it is the present situation that such problems have not been solved yet.

SUMMARY

According to an embodiment of the invention, there is provided a developing agent comprising a carrier; a toner in which an inorganic oxide external additive has a coverage of 60% or more, less than 120% relative to a core toner; and a charging auxiliary particle having charge properties of a positive electrode and having a volume average particle size of from 5 to 15 μm in an addition amount of from 0.5 to 6% by weight relative to the developing agent.

According to an aspect of the invention, there is provided a method for forming an image including stirring a developing agent for charging a toner to be contained in the developing agent, thereby electrostatically depositing the toner onto an image carrier to form a toner image and transferring the toner image onto a transfer medium to form an image, the developing agent including a carrier; a toner in which an inorganic oxide external additive has a coverage of 60% or more, less than 120% relative to a core toner; and a charging auxiliary particle having charge properties of a positive electrode and having a volume average particle size of from 5 to 15 μm in an addition amount of from 0.5 to 6% by weight relative to the developing agent.

Also, according to an aspect of the invention, there is provided an image forming apparatus for including an image carrier for forming a toner image by a toner charged upon stirring of a toner-containing developing agent and forming an image by transferring the toner image formed by the toner on the image carrier onto a transfer medium, the developing agent including a carrier; a toner in which an inorganic oxide external additive has a coverage of 60% or more, less than 120% relative to a core toner; and a charging auxiliary particle having charge properties of a positive electrode and having a volume average particle size of from 5 to 15 μm in an addition amount of from 0.5 to 6% by weight relative to the developing agent.

It is to be understood that both the foregoing general description and the following detailed description are exemplary and explanatory only and are not restrictive of the invention, as claimed.

DESCRIPTION OF THE DRAWINGS

The accompanying drawings, which are incorporated in and constitute a part of this specification, illustrate an embodiment of the invention and together with the description, serve to explain the principles of the invention.

FIG. 5 is a table showing constitutions of developing agents and evaluation results in the Examples and Comparative Examples in an embodiment of the invention.

DETAILED DESCRIPTION

Figure 1:
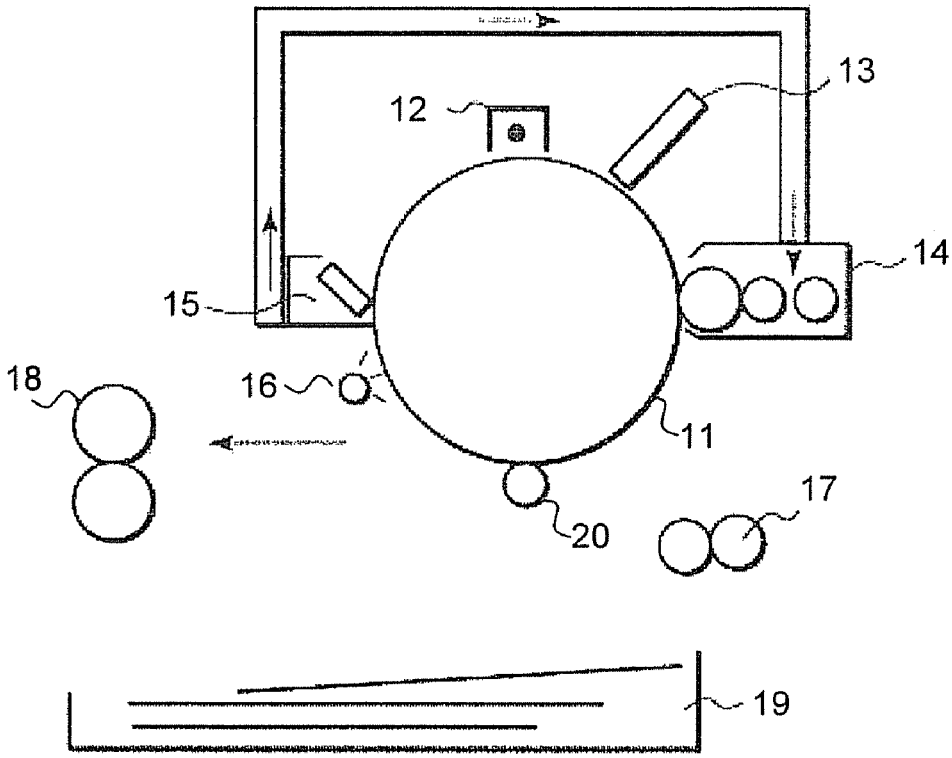
FIG. 1 is a conceptual view of an image forming apparatus by a two-component development process in an embodiment of the invention.

Reference will now be made in detail to the present embodiment of the invention, an example of which is illustrated in the accompanying drawings.

The developing agent of the present embodiment includes a carrier; a toner in which an inorganic oxide external additive has a coverage of from 60 to 120% relative to a core toner; and a charging auxiliary particle having charge properties of a positive electrode and having a volume average particle size of from 5 to 15 μm in an addition amount of from 0.5 to 6% by weight relative to the developing agent.

The method for forming an image of the present embodiment is a method for forming an image including stirring a developing agent for charging a toner to be contained in the developing agent, thereby electrostatically depositing the toner onto an image carrier to form a toner image and transferring the toner image onto a transfer medium to form an image, the developing agent including a carrier; a toner in which an inorganic oxide external additive has a coverage of from 60 to 120% relative to a core toner; and a charging auxiliary particle having charge properties of a positive electrode and having a volume average particle size of from 5 to 15 μm in an addition amount of from 0.5 to 6% by weight relative to the developing agent.

Also, the image forming apparatus of the present embodiment is an image forming apparatus for transferring an image carrier for forming a toner image by a toner charged upon stirring of a toner-containing developing agent and a toner image formed by the toner on the image carrier onto a transfer medium, thereby forming an image, the developing agent including a carrier; a toner in which an inorganic oxide external additive has a coverage of from 60 to 120% relative to a core toner; and a charging auxiliary particle having charge properties of a positive electrode and having a volume average particle size of from 5 to 15 μm in an addition amount of from 0.5 to 6% by weight relative to the developing agent.

Here, a magnetic particle whose surface is coated with a resin, such as ferrite, magnetite and iron oxide, can be used as the carrier. Examples of the resin which can be used for coating the surface include a fluorine resin, a silicone based resin and an acrylic resin.

It is desirable that a volume average particle size of the carrier is from 20 to 80 μm. When the volume average particle size of the carrier is smaller than 20 μm, a magnetic force of a single particle is low so that the carrier is easily separated from the developing agent carrier to easily deposit on the photoconductor, whereas when it is larger than 80 μm, a magnetic brush becomes hard so that a brush mark appears on the image, or the toner cannot be minutely fed. The volume average particle size of the carrier is preferably from 20 to 60 μm, and more preferably from 30 to 50 μm.

The core toner is constituted of a binder resin, a release agent, a coloring agent and the like. The binder resin includes a polyester resin, and it is preferable that the binder resin contains a polyester resin as a major component. Also, a styrene based resin, an acrylic resin, a styrene-acrylic copolymer based resin, a cyclic olefin based resin and the like are useful.

Examples of the release agent include ester based waxes including natural ester waxes such as carnauba wax and rice wax; and ester based waxes synthesized from a carboxylic acid and an alcohol. It is preferable to use such an ester based wax singly or in combination.

The addition amount of the release agent is preferably from 3 to 8 parts by weight based on 100 parts by weight of the binder resin. When the addition amount of the release agent is less than 3 parts by weight, since Tm of the toner becomes high, the generation temperature of low-temperature offset becomes high; and release properties from the fixing contact member are lowered so that the generation temperature of high-temperature offset becomes low, whereby a non-offset temperature region becomes narrow. When the addition amount of the release agent exceeds 8 parts by weight, toner charge properties are deteriorated due to lowering of flow properties of the toner, resulting in lowering of the image quality, and storage properties at a high temperature are deteriorated. The addition amount of the release agent is more preferably from 4 to 7 parts by weight.

Examples of the coloring agent which is used in the present embodiment include carbon black, known pigments and dyes such as condensed polycyclic pigments, azo based pigments, phthalocyanine based pigments and inorganic pigments, which are used as a color toner application.

Examples of the carbon black include acetylene black, furnace black, thermal black, channel black and ketjen black. Examples of the pigment or dye include Fast Yellow G, Benzidine Yellow, Indo Fast Orange, Irgazin Red, Carmine FB, Permanent Bordeaux FRR, Pigment Orange R, Lithol Red 2G, Lake Red C, Rhodamine FB, Rhodamine B Lake, Phthalocyanine Blue, Pigment Blue, Brilliant Green B, Phthalocyanine Green and quinacridone. These materials can be used singly or in admixture.

The addition amount of the coloring agent is preferably from 4 to 10 parts by weight based on 100 parts by weight of the binder resin. When the addition amount of the coloring agent is less than 4 parts by weight, a sufficient image density is not obtainable, whereas when it exceeds 10 parts by weight, the excessive pigment is present in a large amount on the toner surface and is deposited on the photoconductor, whereby filming is easily generated. The addition amount of the coloring agent is preferably from 5 to 8 parts by weight.

It is desirable that a volume average particle size of the thus constituted core toner is from 3 to 8 μm. When the volume average particle size of the core toner is smaller than 3 μm, if a charge quantity sufficient for controlling an electric field is given to each toner particle, the charge quantity per the weight becomes excessively large so that it is difficult to obtain a desired developing amount. When the volume average particle size of the core toner is larger than 8 μm, reproducibility of a high-definition image or graininess is deteriorated. The volume average particle size of the core toner particle is more preferably from 4 to 7 μm.

In the present embodiment, a charge controlling agent for controlling a triboelectrostatic charge quantity or the like may be blended. As the charge controlling agent, a metal-containing azo compound is useful. In the metal-containing azo compound, complexes or complex salts in which a metal element thereof is iron, cobalt or chromium, or mixtures thereof are desirable. Besides, a metal-containing salicylic acid derivative compound or a metal oxide hydrophobilized material is useful. In the metal-containing salicylic acid derivative compound or metal oxide hydrophobilized material, complexes or complex salts in which a metal element thereof is zirconium, zinc, chromium, magnesium, aluminum or boron, or mixtures thereof are desirable.

In order to stabilize flow properties, charge properties or storage properties of the thus constituted core toner, it is necessary to add an external additive composed of a fine particle of an inorganic compound onto the surface of the toner particle in a coverage of 60% or more, less than 120% relative to the core toner. When the coverage is smaller than 60%, or 120% or more, favorable charge properties can not be obtained.

As the inorganic compound to be used for the external additive, inorganic oxides such as silica, titania, alumina, strontium titanate and tin oxide are favorable. From the viewpoint of an enhancement of environmental stability, it is preferable that the external additive is subjected to a surface treatment with a hydrophobic agent. It is preferable that the external additive is a monodispersed fine particle having an average primary particle size of from 5 to 180 nm.

The core toner can be formed by a known method including pulverization and a chemical manufacturing method such as polymerization. In the pulverization, after mixing raw materials including the foregoing binder resin, release agent and coloring agent, kneading and pulverizing, the pulverized mixture is classified to form a core toner. The external additive is further added thereto, thereby forming a toner.

As to a device for mixing and dispersing the raw materials, for example, a mixing machine, a kneading machine or the like is useful. Examples of the mixer include a Henschel mixer (manufactured by Mitsui Mining Co., Ltd.); a super mixer (manufactured by Kawata Mfg., Co., Ltd.); Ribocone (manufactured by Okawara Mfg., Co., Ltd.); a nauta mixer, a turbulizer and a cyclomixer (all of which are manufactured by Hosokawa Micron Corporation); a spiral pin mixer (manufactured by Pacific Machinery & Engineering Co., Ltd.); and a Lodige mixer (manufactured by Matsubo Corporation). The mixing machine is also used for adding the external additive. Examples of the kneading machine include a KRC kneader (manufactured by Kurimoto, Ltd.); a Buss Ko-kneader (manufactured by Buss); a TEM type extruder (manufactured by Toshiba Machine Co., Ltd.); a TEX two-screw kneading machine (manufactured by The Japan Steel Works, Ltd.); a PCM kneading machine (manufactured by Ikegai, Ltd.); a three-roll mill, a mixing roll mill and a kneader (all of which are manufactured by Inoue Mfg., Inc.); Kneadex (manufactured by Mitsui Mining Co., Ltd.); an MS type pressure kneader, a kneader-ruder (manufactured by Moriyama Company Ltd.); and a Banbury mixer (manufactured by manufactured by Kobe Steel, Ltd.).

As to a device for coarsely pulverizing the mixture, for example, a hammer mill, a cutter mill, a jet mill, a roller mill and a ball mill can be used. As a device for finely pulverizing a coarsely pulverized material, a pulverizer is useful. Examples of the pulverizer include a counter jet mill, Micronjet and Inomizer (all of which are manufactured by Hosokawa Micron Corporation); an IDS type mill and a PJM jet pulverizer (all of which are manufactured by Nippon Pneumatic Mfg. Co., Ltd.); Crossjet Mill (manufactured by Kurimoto, Ltd.); Ulmax (manufactured by Nisso Engineering Co., Ltd.); SK Jet-O-Mill (manufactured by Seisin Enterprise Co., Ltd.); Cliptron (manufactured by Kawasaki Heavy Industries, Ltd.); and Turbo Mill (manufactured by Turbo Kogyo Co., Ltd.).

Examples of a classifier for classifying a finely pulverized material include Classiel, Micron Classifier and Spedic Classifier (all of which are manufactured by Seisin Enterprises Co., Ltd.); Turbo Classifier (manufactured by Nisshin Engineering Co., Ltd.); Micron separator, Turboplex (ATP) and TSP Separator (all of which are manufactured by Hosokawa Micron Corporation); Elbow-Jet (manufactured by Nittetsu Mining Co., Ltd.); Dispersion Separator (manufactured by Nippon Pneumatic Mfg. Co., Ltd.); and YM Microcut (manufactured by Yasukawa Shoji K. K.). Examples of a screening device for sieving coarse particles or the like include Ultra Sonic (manufactured by Koei Sangyo Co., Ltd.); Resona Sieve and Gyroshifter (all of which manufactured by Tokuju Corporation); Vibrasonic System (manufactured by Dalton Co., Ltd.); Soniclean (manufactured by Shinto Kogyo Kabushiki Kaisha); Turboscreener (manufactured by Turbo Kogyo Co., Ltd.); Microshifter (manufactured by Makino Mfg. Co., Ltd.); and a circular vibrating separator.

In the polymerization, the core toner is formed by coarsely granulating a mixture containing a binder resin and a coloring agent and mixing the mixture with an aqueous medium; subjecting the obtained mixed liquid to mechanical shearing; and after finely granulating, coagulating the fine particle. Furthermore, the coagulated particle may be fused, if desired. Moreover, the external additive is added thereto, thereby forming the toner.

The charging auxiliary particle is used for the purposes of compensating a lowering of tribocharging ability of the carrier having been deteriorated with time and imparting excellent charge stability. As the charging auxiliary particle, those having charge properties of a positive polarity, such as metal oxides, metallic soaps and resin powders, are useful.

The "charge properties of a positive polarity" as referred to herein refers to the matter that a Q/M charge quantity (μC/g) of a suction blowoff after adding 0.2% by weight (0.2 g) of the charging auxiliary particle to 98.0% by weight (98.0 g) of a carrier composed of ferrite and having a primary particle size of from 20 to 80 μm and stirring for 30 minutes by a Turbula mixer exhibits charge properties of a positive polarity. The Q/M charge quantity is preferably from +20 (μC/g) to +40 (μC/g).

The addition amount of the charging auxiliary particle is required to be from 0.5 to 6% by weight relative to the developing agent. When the addition amount of the charging auxiliary particle is less than 0.5% by weight, a charge imparting mechanism cannot be sufficiently exhibited. On the other hand, when it exceeds 6% by weight, a negative charge to the toner becomes excessive so that defective electrification is caused. The addition amount of the charging auxiliary particle is more preferably from 2 to 4% by weight.

The charging auxiliary particle is required to have a volume average particle size (D50) of from 5 to 15 μm. When the volume average particle size (D50) of the charging auxiliary particle is less than 5 μm, it is difficult to sufficiently impart charging of a negative charge to the toner. On the other hand, when it exceeds 15 μm, a white spot appears on the image, thereby making the image defective. The volume average particle size (D50) of the charging auxiliary particle is more preferably from 5 to 10 μm.

The charging auxiliary particle can be added together with the external additive during the addition to the core toner. The charging auxiliary particle can also be added in the developing agent by, for example, providing a unit for supplementing the charging auxiliary particle in a development unit. When the charging auxiliary particle is added in the developing agent, it causes friction with the carrier which is a magnetic body and is charged with a positive polarity. The charging auxiliary particle causes friction with the toner in place of the carrier having been deteriorated with time, whereby it is able to charge the toner with a negative electrode.

The "charge with a negative polarity" as referred to herein refers to the matter that a Q/M charge quantity (μC/g) of a suction blowoff after mixing 7.5% by weight (7.5 g) of the foregoing toner having an external additive added therein with 92.5% by weight (92.5 g) of a mixture of a carrier composed of ferrite and having a primary particle size of from 20 to 80 μm and the charging auxiliary particle in a ratio of 99.9/0.1 and stirring for 30 minutes by a Turbula mixer exhibits charge properties of a negative polarity.

In order that the coloring properties are not affected, the charging auxiliary particle is preferably colorless or white.

As an image carrier (electrostatic latent image carrier) which is used in an image forming method and an image forming apparatus for forming an image on a transfer medium using the thus constituted developing agent, known photoconductors such as OPC (organic photoconductor) of plus charge or minus charge and amorphous silicon are useful. In these photoconductors, a charge generation layer, a charge transport layer and a protective layer may be stacked, or a layer having a function of plural layers of these layers may be formed. The transfer medium is a medium on which an image is ultimately formed, such as paper.

An image is formed by, for example, the following electrophotographic process using such a developing agent, an image forming method or an image forming apparatus.

(Two-Component Development Process)

An image forming apparatus by a two-component development process is shown in FIG. 1. As shown in FIG. 1, a photoconductor 11; a charge device 12 for charging this; an exposure device 13 for forming an electrostatic latent image; a development unit 14 for feeding a toner particle to the electrostatic latent image; a cleaner 15 for removing a transfer residual toner; a destaticization lamp 16 for removing the electrostatic latent image; a paper feed device 17 for feeding paper which serves as an ultimate transfer medium; a fixing unit 18 for fixing a toner image on paper; and a transfer device 20 for transferring the toner image on the photoconductor 11 onto a transfer medium 19 are disposed. An image is formed on the transfer medium 19 using such an image forming apparatus in the following steps.

The photoconductor 11 such as a belt and a roller is uniformly at a desired potential by the known charge device 12 such as a charge wire, a comb-shaped charger, a corona charger such as a scorotron, a contact charge roller, a non-contact charge roller, a solid charger and a contact charge brush.

For the photoconductor 11, known photoconductors such as OPC (organic photoconductor) of plus charge or minus charge and amorphous silicon are useful. In these photoconductors, a charge generation layer, a charge transport layer and a protective layer may be stacked, or a layer having a function of plural layers of these layers may be formed.

An electrostatic latent image is formed on the photoconductor 11 upon exposure by the exposure device 13 using a known measure such as a laser and LED.

In the development unit 14, a two-component developing agent composed of a carrier and a toner particle is contained in an amount of, for example, from 100 g to 700 g within a hopper. The developing agent is conveyed into a magnetic roller-included development roller by an agitating auger. A charged toner particle is fed to and deposited on the electrostatic latent image on the photoconductor 11 by means of a magnetic brush phenomenon, thereby visualizing the electrostatic latent image. At that time, in order to form an electric field so as to deposit the toner particle uniformly and stably, DC or a development bias with AC superimposed on DC is applied to the development roller.

The toner particle not developed is separated from the developing roller in a peeling pole position of the magnetic roller and collected in a developing agent storage by the agitating auger. A known toner density sensor is installed in the developing agent storage. When the density sensor detects a decrease in an amount of toner, a signal is sent to a toner supply hopper, and a new toner is supplied. At that time, the amount of toner consumption may be estimated from integration of printing data or/and detection of the amount of development toner on the photoconductor, thereby supplying the new toner on the basis thereof. In addition, a measure for estimating both a sensor output and the amount of consumption may be used.

The formed toner image is transferred onto the transfer medium 19 such as paper through an intermediate transfer medium such as a belt or a roller or directly using a known transfer measure such as a transfer roller, a transfer blade and a corona charger, which is disposed in contact with the photoconductor 11 and which transfers the toner image by a transfer voltage to be applied herein.

The transfer medium 19 having the toner image transferred thereonto is peeled from the intermediate transfer medium or the photoconductor 11, conveyed to the fixing unit 18, fixed by a known heating and press fixing measure such as a heat roller and discharged outside the apparatus.

After the toner image is transferred, a transfer residual toner not transferred and remaining on the photoconductor 11 is removed by the cleaner 15. The electrostatic latent image on the photoconductor 11 is erased by the destaticization lamp 16.

The transfer residual toner removed by the cleaner 15 is stored in a waste toner box and then discharged through a conveyance path by the agitating auger or the like. In a recycle system, the transfer residual toner is collected in the developing agent storage of the development unit 14 from the conveyance path and reused.

(Cleanerless Process)

Figure 2:
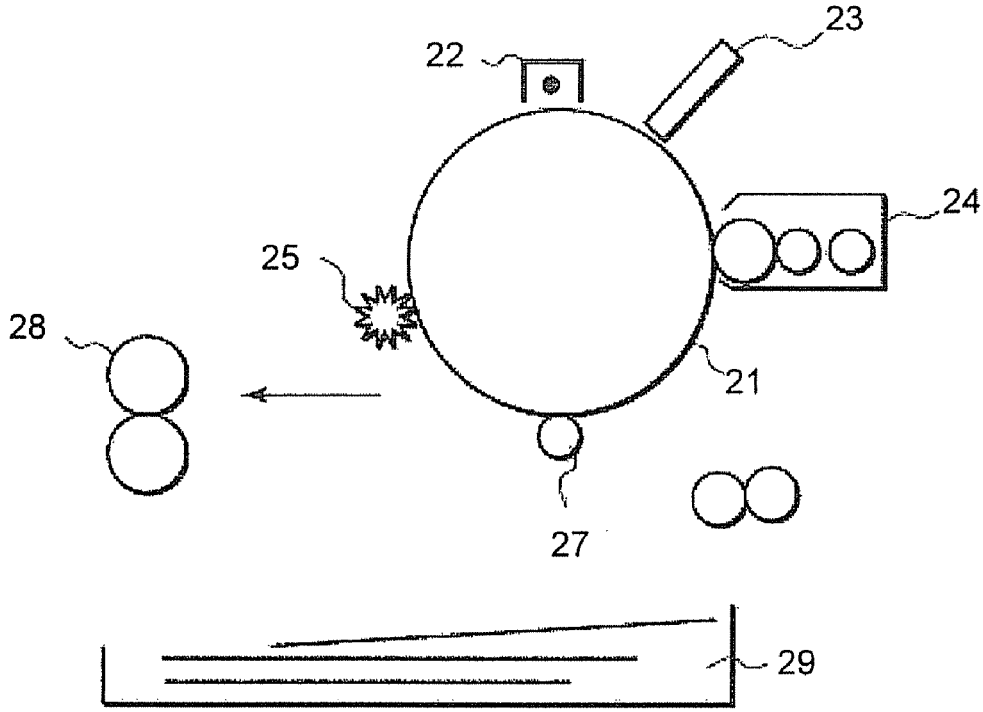
FIG. 2 is a conceptual view of an image forming apparatus by a cleanerless process in an embodiment of the invention.

In a cleanerless process, an image is formed in the same manner by the same image forming apparatus as in the two-component development process. However, as shown in FIG. 2, the cleanerless process is different from the two-component development process in that a cleaner is not provided. A transfer residual toner is collected simultaneously with development without using a cleaner.

Similar to the two-component development process, a photoconductor 21 is charged and exposed, a toner particle is deposited thereon and developed, and a toner image is transferred onto a transfer medium 29 via an intermediate transfer medium or directly, and fixing by a fixing unit 28. In FIG. 2, a direct transfer method is employed, thereby achieving transfer by a transfer roller 27. A transfer residual toner remaining in a non-image area is kept remaining on the photoconductor 21 and conveyed to a development region again through steps of next destaticization, charge by a charge device 22 and exposure by an exposure device 23. The transfer residual toner is collected in a development unit 24 by a magnetic brush serving as a developing agent carrier and developed anew.

Before or after the destaticization step, a memory disturbing member 25 such as a fixed brush, felt, a rotating brush and a lateral sliding brush may be disposed. A temporary collection member may be disposed, thereby collecting the transfer residual toner once, releasing again it on the photoconductor 21 again and then collecting in the development unit 24. Further, a toner charging device may be disposed on the photoconductor 21 in order to adjust an amount of charges of the transfer residual toner at a desired value. Furthermore, one member may carry out a part or all of the roles of the toner charging device, the memory disturbing member, the temporary collection member and the charge device. A positive or negative DC or AC voltage may be applied to these members for the purpose of efficiently carrying out the functions.

For example, tips of two lateral sliding brushes which carry out all the three roles are provided between the transfer region and the charge member of the photoconductor 21 so as to come into contact with the photoconductor 21. A voltage of the same polarity as in the development toner charge is applied to the brush on the upstream side, and a voltage of the opposite polarity from the development toner charge is applied to the brush on the downstream side.

A toner of the opposite polarity and a toner of the same polarity having an extremely high charge are mixed in the transfer residual toner. The toner of the opposite polarity coming into contact with the brush of the same polarity slips through the brush with a charge thereof reversed or is collected by the brush once. The transfer residual toner reaching the brush of the opposite polarity downstream from the brush of the same polarity has entirely the same polarity as in the development toner. When the transfer residual toner comes into contact with the brush of the opposite polarity, since a strong charge of the same polarity is relaxed, the transfer residual toner slips through the brush or is collected by the brush once.

The transfer residual toner, which has been adjusted to a low amount of charges and has lost an image structure because of mechanical contact of the brush, is charged together with the photoconductor 21 by the charging member of the photoconductor 21 in a non-contact manner and adjusted to an amount of charges in just the same amount as in the development toner. Consequently, in the development region, the transfer residual toner in a non-image portion in a new latent image is collected in the development unit 24. The transfer residual toner in an image portion is directly transferred to the transfer medium together with toner particles supplied from the development unit 24 anew.

(Quadruple Tandem Process)

Figure 3:
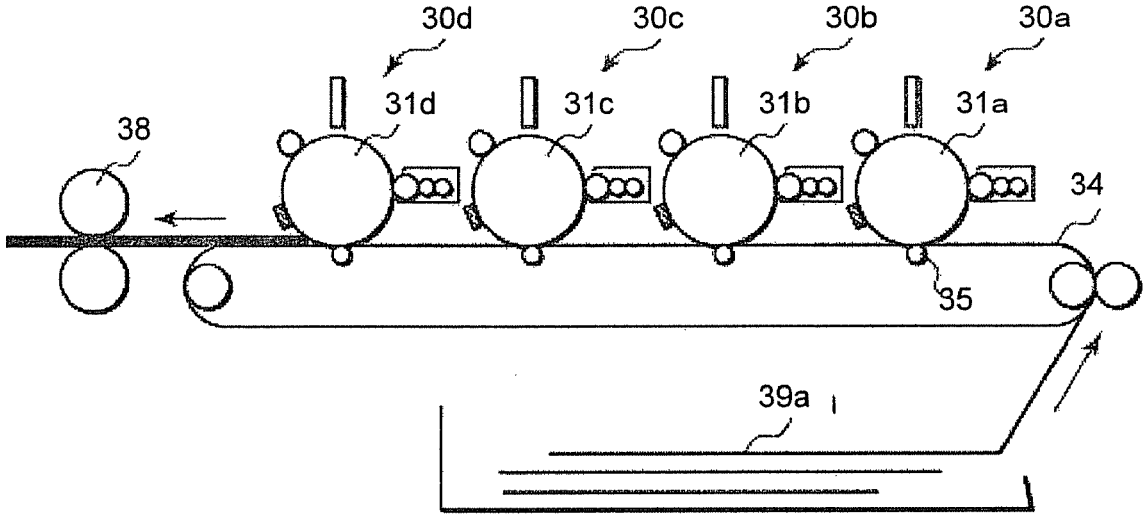
FIG. 3 is a conceptual view of an image forming apparatus by a quadruple tandem process in an embodiment of the invention.

An image forming apparatus according to a quadruple tandem process is shown in FIG. 3. As shown in FIG. 3, image forming units 30*a*, 30*b*, 30*c* and 30*d* for four colors including development units containing toner particles of colors of yellow, magenta, cyan and black, respectively, photoconductors and charging, exposing and development devices are provided and arranged in parallel along a conveyance path for a transfer medium 39*a*. Similar to FIG. 1, a fixing unit 38 for fixing a toner image on paper is arranged. An image is formed according to steps described below using such an image forming apparatus. In an example explained below, the colors are arranged in the order of yellow, magenta, cyan and black.

In the yellow image forming unit, a yellow toner image is formed on a photoconductor 31*a* and transferred onto the transfer medium 39*a*. In case of direct transfer, paper or the like serving as an ultimate transfer medium is conveyed by a conveying member such as a transfer belt and a roller and fed to a transfer region of the yellow image unit. In FIG. 3, a configuration in which transfer is carried out on paper conveyed by a transfer belt 34 as the conveyance member by a transfer roller 35 is shown. A volume resistance of the transfer belt is desirably from $10^7$ Ωcm to $10^{12}$ Ωcm. A rubber material such as an ethylene-propylene rubber (EPDM) and chloroprene rubber (CR) or a resin material such as polyimides, polycarbonates, polyvinylidene difluoride (PVDF) and ethylenetetrafluoroethylene (ETFE) is used for the transfer belt. The transfer belt can be formed in various configurations in which a resin sheet, a rubber elastic layer, a protective layer, etc. are formed as a single layer or stacked in two or more layers. As the transfer system, it is possible to use a known transfer measure such as a transfer roller, a transfer blade and a corona charger.

In the transfer position, a transfer bias voltage with prescribed size and polarity is fed by a transfer bias power device from the transfer roller 35 provided such that the transfer belt 34 coming into contact with the photoconductor 31*a* is pressed on the side of the photoconductor 31*a* to the transfer medium 39*a* positioned between the transfer belt 34 and the photoconductor 31*a*. When this transfer bias voltage is applied, a toner image (toner) deposited electrostatically on the outer periphery of the photoconductor 31*a* is drawn to the transfer medium 39*a* and transferred onto the transfer medium 39*a*.

Figure 4:
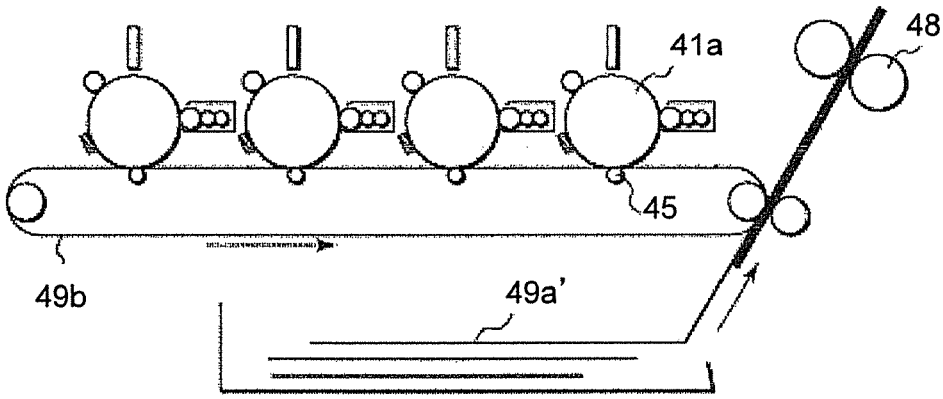
FIG. 4 is a conceptual view of an image forming apparatus by a quadruple tandem process provided with an intermediate transfer medium in an embodiment of the invention.

As shown in FIG. 4, an intermediate transfer belt 49*b* may be provided as the intermediate transfer medium. The intermediate transfer belt 49*b* has semi-conductivity; a resin or a rubber or a stacked member thereof having a thickness of from 50 to 3,000 μm is used; and a transfer roller 45 (transfer measure) is brought into contact with a back surface side of the belt opposing to the side of the photoconductor 41*a*. A prescribed transfer bias voltage is applied to the transfer roller 45 by a transfer bias voltage applying part, whereby a transfer electric field is applied to a transfer nip part where the photoconductor 41*a* and the intermediate transfer belt 49*b* come into contact with each other or the surroundings thereof.

In the present embodiment, the transfer roller 45 using a semiconductor sponge having a volume resistivity of from $10^5$ Ωcm to $10^9$ Ωcm is brought into contact with the back surface of the belt, and DC of from 300 V to 3,000 V is applied, whereby the toner image on the photoconductor of each of the process units is transferred onto the intermediate transfer belt 49*b*. By arranging four of such process units and performing superimposing transfer, a full-color image is formed. Thereafter, the image is transferred onto a transfer medium 49*a*' such as paper in a secondary transfer position and heated for fixing by a fixing unit 48 to form an ultimate image.

As to the intermediate transfer belt, one having the same material and configuration as in the foregoing transfer belt 34 is useful. Its surface resistance is desirably from $10^7$ Ωcm to $10^{12}$ Ωcm, for example, $10^9$ Ωcm.

In the magenta image forming unit 30*b*, similarly, a magenta toner image is formed on a photoconductor 31*b*, the transfer medium 39*a* having a yellow toner image already transferred thereon is fed into the transfer region of the magenta image forming unit 30*b*, and the magenta toner image is transferred on the yellow toner image with a position of the magenta toner image adjusted to a position of the yellow toner image. At this time, the yellow toner on the conveyance medium may be inversely transferred onto the magenta photoconductor 31*b* depending on the amount of the toner charge and the intensity of a transfer electric field by the contact with the magenta photoconductor 31*b*.

In the cyan and black image forming units 30*c* and 30*d*, similarly, toner images are formed and sequentially transferred to be superimposed on the transfer medium 39*a*. Similarly, the toner at the preceding stage may be inversely transferred onto cyan and black photoconductors 31*c* and 31*d*, respectively.

The transfer medium 39*a* having the toner images of the four colors superimposed thereon is peeled from the conveyance member, conveyed to the fixing unit 38 to have the toner images fixed thereon by a known heating and press fixing system such as a heat roller, and discharged to the outside of the apparatus. When the intermediate transfer medium 49*b* is used (FIG. 4), the toner images of the four colors are collectively transferred onto the ultimate transfer medium 49*a*' such as paper supplied to secondary transfer measure by a feeding member. Thereafter, the ultimate transfer medium 49*a*' is conveyed to the fixing unit 48 to have the toner images fixed thereon in the same manner and discharged to the outside of the apparatus.

In the respective image forming units, as in the two-component development process, the photoconductors 31*a*, 31*b*, 31*c* and 31*d* are subjected to destaticization to have a transfer residual toner and an inversely transferred toner removed in a cleaning step and then return to the image formation process. In the development unit, a toner specific density is adjusted as in the two-component development process. In the example explained above, the image forming units are arranged in the order of colors of yellow, magenta, cyan and black. However, the order of colors is not particularly limited.

(Quadruple Tandem Cleanerless Process)

In a quadruple tandem cleanerless process, an image is formed in the same manner by the same image forming apparatus as the quadruple tandem process. Similar to the foregoing cleanerless process, the quadruple tandem cleanerless process is different from the quadruple tandem process in that a cleaner is not provided. A transfer residual toner and an inversely transferred toner are collected simultaneously with development without using a cleaner by adjusting an amount of charge in the same manner as the cleanerless process.

The invention is specifically described below with reference to the following Examples. Here, COULTER MULTISIZER III, manufactured by Beckman Coulter is used for the measurement of a toner particle size; a suction blowoff, manufactured by Kyocera Chemical Corporation is used for the measurement of a charge quantity of a developing agent; and a spectrophotometer MODEL 938, manufactured by X-Rite, Inc. is used for the measurement of fog.

Example 1

The following materials were blended in a ratio described below.

| | |
|---|---|
| Binder resin (polyester based): | 90.5% by weight |
| Wax (rice wax): | 4.5% by weight |
| Coloring agent (carbon): | 5% by weight |
| Antistatic agent (metal-containing salicylic acid derivative): | 0.5% by weight |

These materials were mixed in a Henschel mixer and then melt kneaded by a twin-screw extruder. The obtained melt kneaded material was cooled and then coarsely pulverized by a hammer mill; and subsequently, the coarsely pulverized material was finely pulverized by a jet pulverizer and classified to form a core toner having a volume average particle size (D50) of 5 μm.

To 100 parts of the core toner, 4.5% by weight in total of external additives were added in a coverage of 90% relative to the core toner. Furthermore, a white (colorless) metal oxide having an average primary particle size of 5 μm was added as a charging auxiliary particle in an amount of 2% relative to the total amount of the developing agent.

The external additives were thrown together with the core toner into a Henschel mixer and mixed. At that time, for the purpose of reducing friction between a photoconductor and a cleaning blade, 0.1% by weight of a lubricant was also added. After mixing them, the charging auxiliary particle was thrown into the Henschel mixer, and mixed again.

The obtained mixture of toner and charging auxiliary particle were stirred in a proportion of 6 parts by weight based on 100 parts by weight of a ferrite carrier having a surface coated with a silicone resin and having an average particle size of from 20 to 60 μm in a Turbula mixer, thereby obtaining a developing agent.

The obtained developing agent was evaluated in the following manners.

[Evaluation of Fog]

An image was copied on white paper, and a copy image was measured using a spectrophotometer. The case of ΔE of not more than 1.00% at which a satisfactory image is obtainable was designated as "good", and the case of ΔE of 1.01% or more was designated as "poor", respectively.

[Evaluation of Image Failure Due to Staining within an Apparatus]

By using Toshiba's e-STUDIO 3510c as an evaluation apparatus, a chart having a printing ratio of 6% was subjected to a printing durability test with 150,000 sheets, thereby evaluating the presence or absence of staining within the apparatus and the presence or absence of the generation of image failure (for example, carrier trailing or color streak) due to staining in a charging unit by toner flying. The case where the both were not observed was designated as "good", and the case where either one of them was observed was designated as "poor", respectively.

The results of these evaluations are shown in FIG. 5. As shown in FIG. 5, satisfactory results were obtained in the respective evaluations.

Example 2

A toner having a volume average particle size of 5 μm and the addition amount of external additives of 3% by weight (coverage of the core toner: 60%) as shown in FIG. 5 was obtained in the same manner as in Example 1. The toner was mixed with the carrier in the same manner as in Example 1 while setting up the addition amount of the charging auxiliary particle at 4%, thereby preparing a developing agent, followed by evaluation in the same manners. The evaluation results are also shown in FIG. 5. As shown in FIG. 5, satisfactory results were obtained in the respective evaluations.

Example 3

A toner having a volume average particle size of 10 μm and the addition amount of external additives of 2.5% by weight (coverage of the core toner: 90%) as shown in FIG. 5 was obtained in the same manner as in Example 1. The toner was mixed with the carrier in the same manner as in Example 1 while setting up the addition amount of the charging auxiliary particle at 2%, thereby preparing a developing agent, followed by evaluation in the same manners. The evaluation results are also shown in FIG. 5. As shown in FIG. 5, satisfactory results were obtained in the respective evaluations.

Example 4

A toner having a volume average particle size of 8 μm and the addition amount of external additives of 2% by weight (coverage of the core toner: 60%) as shown in FIG. 5 was obtained in the same manner as in Example 1. The toner was mixed with the carrier in the same manner as in Example 1 while setting up the addition amount of the charging auxiliary particle at 4%, thereby preparing a developing agent, followed by evaluation in the same manners. The evaluation results are also shown in FIG. 5. As shown in FIG. 5, satisfactory results were obtained in the respective evaluations.

Example 5

A toner having a volume average particle size of 7 μm and the addition amount of external additives of 3.5% by weight (coverage of the core toner: 90%) as shown in FIG. 5 was obtained in the same manner as in Example 1. The toner was mixed with the carrier in the same manner as in Example 1 while setting up the addition amount of the charging auxiliary particle at 3%, thereby preparing a developing agent, followed by evaluation in the same manners. The evaluation results are also shown in FIG. 5. As shown in FIG. 5, satisfactory results were obtained in the respective evaluations.

COMPARATIVE EXAMPLE 1

A toner having a volume average particle size of 7 μm and the addition amount of external additives of 4.5% by weight (coverage of the core toner: 120%) as shown in FIG. 5 was obtained in the same manner as in Example 1. The toner was mixed with the carrier in the same manner as in Example 1 while setting up the addition amount of the charging auxiliary particle at 3%, thereby preparing a developing agent, followed by evaluation in the same manners. The evaluation results are also shown in FIG. 5. As shown in FIG. 5, the addition amount of the external additives to the toner is in excess, the coverage is high, and the charging auxiliary particle is added thereto; and therefore, favorable charge properties were not obtained, and satisfactory results were not obtained in the evaluation of fog.

COMPARATIVE EXAMPLE 2

A toner having a volume average particle size of 7 μm and the addition amount of external additives of 1% by weight (coverage of the core toner: 30%) as shown in FIG. 5 was obtained in the same manner as in Example 1. The toner was mixed with the carrier in the same manner as in Example 1 while setting up the addition amount of the charging auxiliary particle at 1%, thereby preparing a developing agent, followed by evaluation in the same manners. The evaluation results are also shown in FIG. 5. As shown in FIG. 5, the addition amount of the external additives to the toner is small, and the coverage is low; and therefore, even by adding a small amount of the charging auxiliary particle, favorable charge properties were not obtained, and satisfactory results were not obtained in both the evaluation of fog and the evaluation of image failure due to staining within the apparatus.

COMPARATIVE EXAMPLE 3

A toner having a volume average particle size of 5 μm and the addition amount of external additives of 2.5% by weight (coverage of the core toner: 50%) as shown in FIG. 5 was obtained in the same manner as in Example 1. The toner was mixed with the carrier in the same manner as in Example 1 while setting up the addition amount of the charging auxiliary particle at 1.5%, thereby preparing a developing agent, followed by evaluation in the same manners. The evaluation results are also shown in FIG. 5. As shown in FIG. 5, the addition amount of the external additives to the toner is small, and the coverage is low; and therefore, even by adding a small amount of the charging auxiliary particle, favorable charge properties were not obtained, and satisfactory results were not obtained in both the evaluation of fog and the evaluation of image failure due to staining within the apparatus.

COMPARATIVE EXAMPLE 4

A toner having a volume average particle size of 5 μm and the addition amount of external additives of 6% by weight (coverage of the core toner: 120%) as shown in FIG. 5 was obtained in the same manner as in Example 1. The toner was mixed with the carrier in the same manner as in Example 1 while setting up the addition amount of the charging auxiliary particle at 4%, thereby preparing a developing agent, followed by evaluation in the same manners. The evaluation results are also shown in FIG. 5. As shown in FIG. 5, the addition amount of the external additives to the toner is in excess, the coverage is high, and the charging auxiliary particle is added thereto; and therefore, favorable charge properties were not obtained, and satisfactory results were not obtained in both the evaluation of fog and the evaluation of image failure due to staining within the apparatus.

COMPARATIVE EXAMPLE 5

A toner having a volume average particle size of 10 μm and the addition amount of external additives of 3% by weight (coverage of the core toner: 120%) as shown in FIG. 5 was obtained in the same manner as in Example 1. The toner was mixed with the carrier in the same manner as in Example 1 while setting up the addition amount of the charging auxiliary particle at 0.1%, thereby preparing a developing agent, followed by evaluation in the same manners. The evaluation results are also shown in FIG. 5. As shown in FIG. 5, the addition amount of the external additives to the toner is in excess, the coverage is too high, and the addition amount of the charging auxiliary particle is too small; and therefore, favorable charge properties were not obtained, and satisfactory results were not obtained in both the evaluation of fog and the evaluation of image failure due to staining within the apparatus.

COMPARATIVE EXAMPLE 6

A toner having a volume average particle size of 8 μm and the addition amount of external additives of 2% by weight (coverage of the core toner: 60%) as shown in FIG. 5 was obtained in the same manner as in Example 1. The toner was mixed with the carrier in the same manner as in Example 1 while setting up the addition amount of the charging auxiliary particle at 6%, thereby preparing a developing agent, followed by evaluation in the same manners. The evaluation results are also shown in FIG. 5. As shown in FIG. 5, the addition amount of the external additives to the toner and the coverage were favorable, but the addition amount of the charging auxiliary particle was too large; and therefore, favorable charge properties were not obtained, and satisfactory results were not obtained in the evaluation of fog.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A developing agent comprising a carrier;

a toner including a core toner, and an inorganic oxide external additive, and a surface coverage of the inorganic oxide external additive is 60% or more to less than 120% relative to the core toner; and a charging auxiliary particle having charge polarity opposite to charge polarity of the toner and having a volume average particle size of from 5 to 15 μm in an addition amount of from 0.5 to 6% by weight relative to a two component developing agent which includes the carrier and the toner.

2. The developing agent according to claim 1, wherein the charging auxiliary particle is colorless or white.

3. The developing agent according to claim 1, wherein the charging auxiliary particle contains at least one of metal oxides, metallic soaps and resin powders.

4. The developing agent according to claim 1, wherein the charging auxiliary particle has a charge quantity of from +20 to +40 μC/g.

5. The developing agent according to claim 1, wherein the addition amount of the charging auxiliary particle is from 2 to 4% by weight relative to the two component developing agent.

6. The developing agent according to claim 1, wherein the carrier has a primary particle size of from 20 to 80 μm.

7. The developing agent according to claim 6, wherein the carrier has a primary particle size of from 20 to 60 μm.

8. The developing agent according to claim 7, wherein the surface coverage of the inorganic oxide external additive is from 60 to 100% relative to the core toner.

9. An image forming method comprising:

stirring a developing agent which includes:

a carrier;

a toner including a core toner, and an inorganic oxide external additive, and a surface coverage of the inorganic oxide external additive is 60% or more to less than 120% relative to the core toner; and a charging auxiliary particle having charge polarity opposite to charge polarity of the toner and having a volume average particle size of from 5 to 15 μm in an addition amount of from 0.5 to 6% by weight relative to a two component developing agent which includes the carrier and the toner;

charging the toner in response to the stirring;

depositing the toner onto an image carrier electrostatically to form a toner image; and transferring the toner image onto a transfer medium to form the toner image.

10. The method according to claim 9, wherein the charging auxiliary particle is colorless or white.

11. The method according to claim 9, wherein the charging auxiliary particle contains at least one of metal oxides, metallic soaps and resin powders.

12. The method according to claim 9, wherein the charging auxiliary particle has a charge quantity of from +20 to +40 μC/g.

13. The method according to claim 9, wherein the addition amount of the charging auxiliary particle is from 2 to 4% by weight relative to the developing agent.

14. The method according to claim 9, wherein the carrier has a primary particle size of from 20 to 80 μm.

* * * * *